United States Patent [19]

Kutzner

[11] Patent Number: 4,741,133

[45] Date of Patent: May 3, 1988

[54] TRANSPORTABLE SHELTER

[76] Inventor: Jürgen Kutzner, Alsenstrasse 26b, D-1000 Berlin 39, Fed. Rep. of Germany

[21] Appl. No.: 926,087

[22] PCT Filed: Mar. 5, 1986

[86] PCT No.: PCT/DE86/00091

§ 371 Date: Nov. 3, 1986

§ 102(e) Date: Nov. 3, 1986

[87] PCT Pub. No.: WO86/05223

PCT Pub. Date: Sep. 12, 1986

[30] Foreign Application Priority Data

Mar. 5, 1985 [DE] Fed. Rep. of Germany ..... 3508188

[51] Int. Cl.[4] ..... E04B 1/344; E04B 1/343

[52] U.S. Cl. ..... 52/79.5; 52/143

[58] Field of Search ..... 52/79.5, 66–71, 52/143

[56] References Cited

U.S. PATENT DOCUMENTS 3,348,344 10/1967 Tatevossian ..... 52/79.5 X 3,849,952 11/1974 Hanaoka ..... 52/79.5

FOREIGN PATENT DOCUMENTS 0077103 4/1983 European Pat. Off. .

0109108 5/1984 European Pat. Off. .

2132176 1/1973 Fed. Rep. of Germany .

2258827 6/1974 Fed. Rep. of Germany .

2641142 3/1978 Fed. Rep. of Germany .

2172932 10/1973 France .

1356242 6/1974 United Kingdom ..... 52/79.5

*Primary Examiner*—J. Karl Bell

*Attorney, Agent, or Firm*—Spencer & Frank

[57] ABSTRACT

A transportable shelter with a basic structure having the dimensions of a container and being transportable as such, wherein, in order to enlarge the inner space, at least one side wall can be moved generally parallel to its position in the transport state towards the outside, wherein additional side walls, connected with the movable side wall, can be folded in accordion-like fashion, while a floor and ceiling element for the enlarged room area are fastened to the upper or lower longitudinal edge of the basic structure having the dimensions of a container.

14 Claims, 6 Drawing Sheets

SECTION D-D

SECTION D-D

SECTION C-C

SECTION C-C

TRANSPORTABLE SHELTER

BACKGROUND OF THE INVENTION

1. Field of the Invention

The invention relates to a transportable shelter which is reducible for transport. The shelter has a box-like structure when it is in the transport configuration.

2. Discussion of the Prior Art

Such shelters are already known, affording the possibility of obtaining additional space by the stretching of canvas or by use of other attachable (identical) elements. These containers are stackable and are used as construction shelters or for similar purposes. But they are not very suitable for giving comfortable shelter to several persons over longer periods of time.

SUMMARY OF THE INVENTION

An object of the present invention is the creation of a shelter not requiring any additional transportation effort over the usual transport containers, but which, on the other hand, can easily and in a comparatively short time and in place, be expanded to a large extent to form a larger and more comfortable shelter.

The invention is based on the knowledge that, by adding elements to a box-like base structure, especially one of the dimensions of a standard container, additional areas can be formed by means of foldable sidewalls, which are not inferior to a solidly constructed unit, since solid room elements are used.

There are, particularly and in accordance with advantageous exemplary embodiments, numerous ways of conversion because of the provision of a generally diagonally extending separating wall with connecting doors and extendable stairs during stacking, which make it possible to quickly adapt the shelter to differing requirements.

This is preferably achieved by having at least one side wall of the box-like shelter consist of three foldable or hinged elements. The first element, outside during transport, is fastened with a hinge in its upper part and folds upward, forming the roof for the newly created space. The second elements, resting behind it—in the folded state—forms the front wall and can be folded out in accordion fashion, along with the partitioned side walls fastened to it. The third inner element is maintained by a lower hinge and folded out downwardly, thereby forming the floor surface of the additional box-line room. Floor and ceiling surface each form a firm, one-piece plate fastened to the box-like structure by means of hinges.

Each side wall extended in this manner increases the base area of the transportable shelter by the size of its own area. After all side walls have been unfolded, the base area has been increased nearly five-fold. The larger room unit thus created can preferably be partitioned into two symmetrical units diagonally.

All facilities depending on the supply with and removal of electricity, water and gas, such as bathroom, sink, refrigerator, cooking facility and heating, as well as some closets, are accomodated in the center in the permanent part of the shelter. Certain devices, such as air conditioners, water reservoirs, etc. can therefore advantageously be used simultaneously for both room units.

Also located in the central part and in the floor is at least one telescoping stairs which is storable during periods of occupation and which can, when needed, provide a connection with the lower room unit in the case of two transportable shelters.

Other living elements, such as beds which can be in part converted to corner seats, as well as tables and chairs, are preferably fastened to the foldable floor surfaces. All doors leading to the outside and all windows are either—covered in the folded state—in the foldable front walls or in the side walls fastened to the front walls, so that the transportable shelter in the folded state is completely closed in on itself and windows and doors are hemetically protected against damage during transport. In order to connect two living units created by the diagonal separation when needed, doors are provided in the inner part of each shelter.

BRIEF DESCRIPTION OF THE DRAWINGS

Advantageous improvements of the invention are described by the following exemplary embodiments. Shown in.

DESCRIPTION OF THE PREFERRED EMBODIMENTS

Figure 1A:
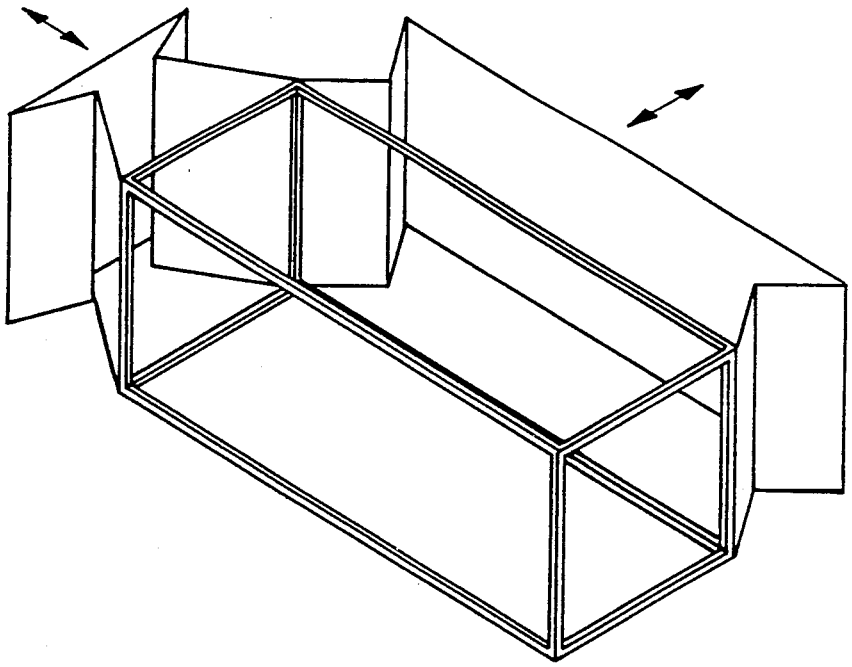
FIG. 1*a*, an exemplary embodiment in which the expandability of the container-like basic structure is shown in a perspective view, FIG. 1*b*, a corresponding view of exemplary embodiment in plan view, FIGS. 2*a* to 2*d*, detailed views of the folding mechanisms, FIGS. 3 and 3*a* to 3*d*, the same exemplary embodiment with the preferred placement of the interior facilities in plan view and corresponding sectional views, as well as in a perspective view.

The examplary embodiment shown in FIG. 1*a* of the shelter according to the invention shows in a perspective view the folding mechanism for two side walls. A longitudinal and a cross side wall, each, can be folded open or closed in an accordion-like manner (in the direction of the arrow) by means of additional side walls, so that during transport a reduction of the dimensions of the box-like basic container becomes possible, while in the stationary state the inner space can be considerably enlarged. The floor and ceiling elements of the extended areas have been left out in the drawing according to FIG. 1*a* for reasons of clarity.

FIG. 2 shows a corresponding plan view of the exemplary embodiment of the transportable shelter in which the function as hinges of the foldable sidewalls can also be seen. It can be seen in the plan view—starting with the small sidewall below and proceeding in a counter-clockwise direction—how the several side walls can be moved increasingly outward during the enlargement of the inner space for the purpose of shelter, wherein accordion-like foldable additional walls provide the connection between the movable (outer) side walls and the box-like basic structure. The box-like basic structure consists, besides the floor and ceiling element with which the one-piece hingable floor and cover parts of the expansion area are connected by means of hinges, of four vertical corner columns keeping floor and cover part of the basic structure at a distance from one another. The accordion-like foldable connecting walls are connected hinge-like to these corner columns.

The following further description of the preferred exemplary embodiment is made with reference to FIGS. 2*a* to *d* and 3*a* to *d* at the same time, wherein the references can be seen based on the reference numerals or the section indications.

Figure 1B:
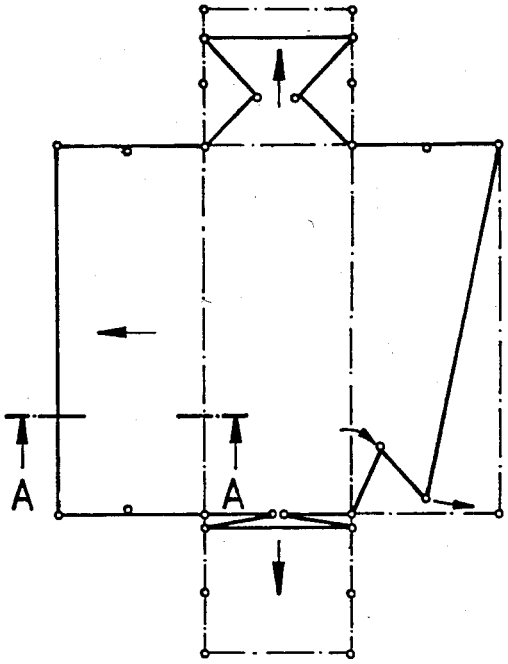
Figure 2A:
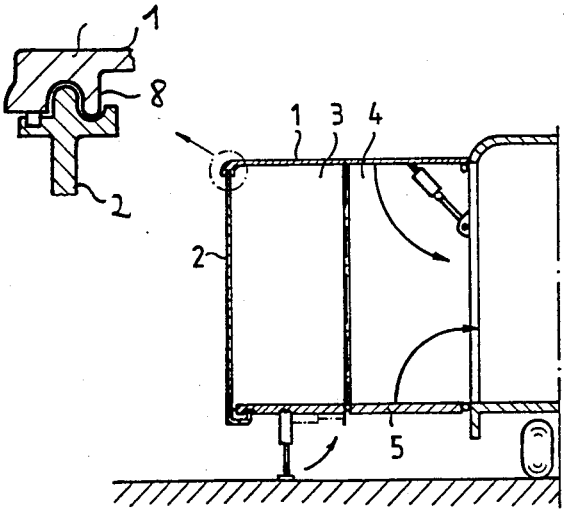

A further side wall area in its unfolded state is visible in the sectional view according to FIG. 2*a* (according to section A—A in FIG. 1*b*).

Figure 2B:
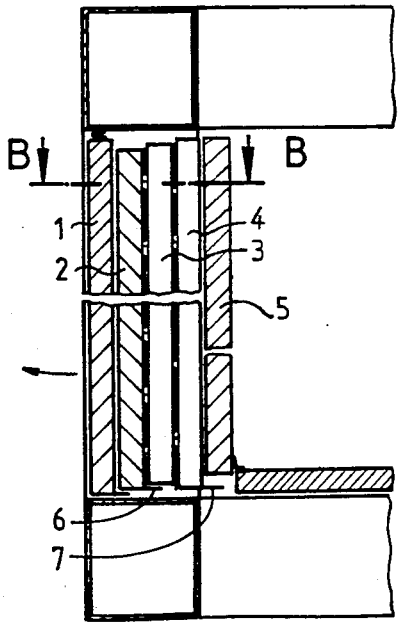

FIG. 2*b* shows the same arrangement in section in its folded state and in enlarged scale. All wall, floor and ceiling elements 1 to 5 are close together and require a minimum of space during transport.

To unfold in order to achieve the enlarged living space the following procedure is followed:

First the outer element (one-piece ceiling plate) 1 is hinged upwards and forms the roof, then the center element (side wall) 2 is pushed outwardly, along with the side walls 3, 4 attached to it by hinges, and folded out accordion-like, finally, the inner element (one-piece floor element) 5 is folded down and forms the floor of the extended part. The floor plate rests on corresponding support elements 2*a*, 6 and 7, which are provided in the area of the lower edge at the front wall 2 or the side walls 4.

The detail at the upper left of FIG. 2*a* shows how the extended wall 2 and the roof 1 mesh with the grooves 8 in the area of their edges and in this manner assure a seal against the outside weather conditions.

Figure 2C:
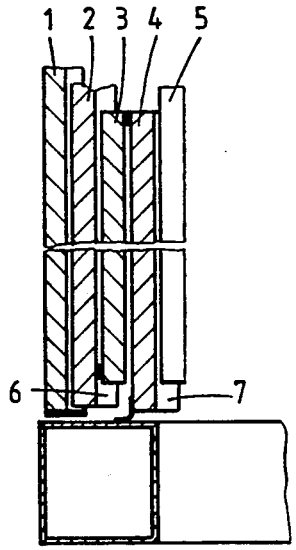
Figure 2D:
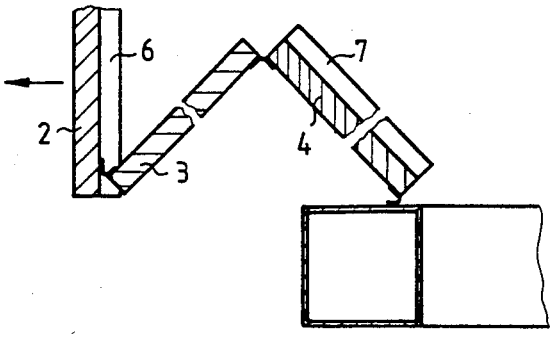

Correspondingly, in FIGS. 2*c* and 2*d* and in accordance with the section B—B shown in FIG. 2*b*, the arrangement of elements 1 to 7 of a side part aiding in the enlargement of the living area is shown in plan view in the closed and partially opened view to increase the living area.

Figure 3A:
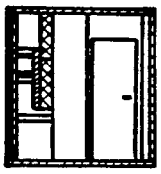
FIG. 3*e* shows a perspective view of the housing with various additional features illustrated.
Figure 3B:
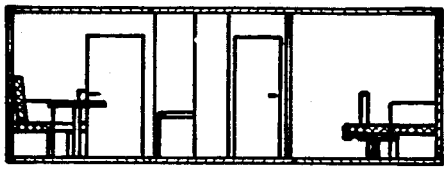
Figure 3:
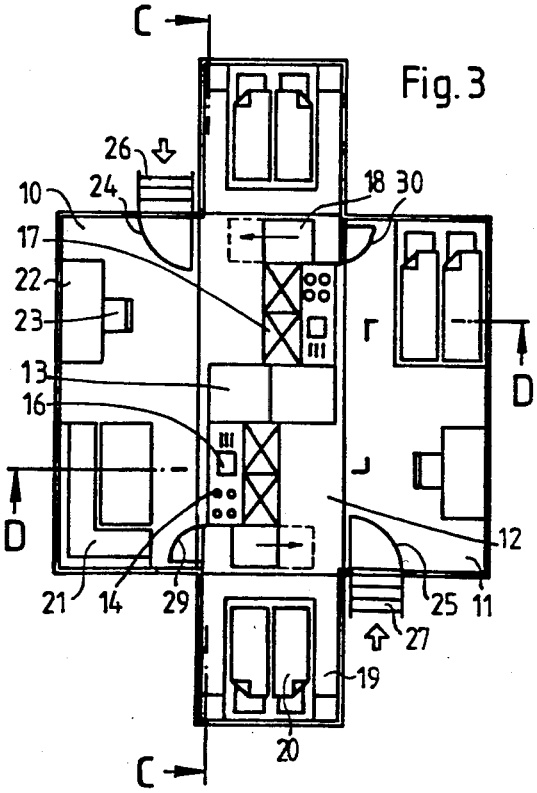
Figure 3C:
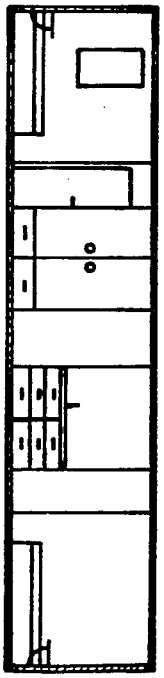
Figure 3D:
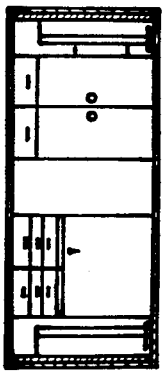

FIGS. 3 to 3*d* show views of the folded-open preferred embodiment of the transportable shelter, including all interior accomodations, in plan view or the corresponding side views. The diagonal partition of the basic area into two living units 10, 11 can be seen.

The supply units are provided in the central unit 12, common to the living units: a shower with a toilet 13, a cooking surface 14 with refrigerator, sink 16 and cabinets 17. In the floor of the central part, telescoping stairs 18 are incorporated. The folded-open narrow floor units 19 are equipped with beds 20. Beds 21 have also been mounted on the wide folded-open floor plates and can be changed into a bench with a table. Furthermore, a table 22 and chairs (23) are provided here.

Entry from outside is made through doors 24, 25, located in the hinged side walls, which can be reached via stairs 26, 27. In the hinged front wall or in its side walls windows are also provided. Connecting doors 29, 30 can be either kept open or closed between the living units 10, 11.

The stairs 18 come into use when similar living units with expanded inner areas are stacked on top of each other. Since the expansion areas also form a solid structure because of their one-piece outer side walls and the one-piece floor and ceiling plates, the living units also provide in this form stable cells with large load factors. Corresponding connecting parts are provided for the stacking, the same as correspondingly make possible the stacking of containers.

FIGS. 3*a* and 3*b* show the preferred embodiment in sectional view in accordance with section D—D in a folded and folded-out position.

In FIGS. 3*c* and 3*d* the transportable shelter is shown in longitudinal section in accordance with section C—C in folded-open and folded position for transporting.

Figure 3E:
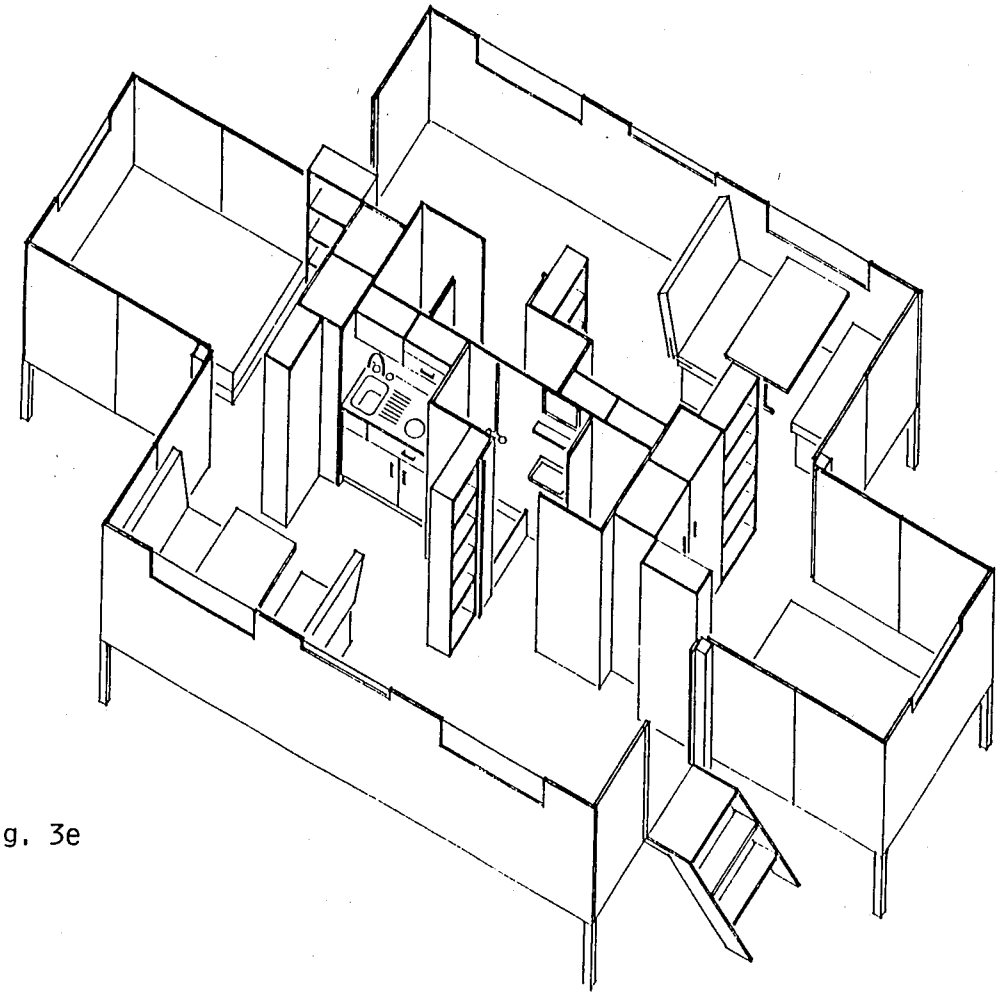

A corresponding arrangement is shown perspectively in FIG. 3*e*.

In transportable configuration the living unit in accordance with the invention has preferably the same dimension as a standard transport container. Correspondingly the means to ease and secure the loading and stacking present in such containers are provided, so that transport and storing with these containers is easily possible. The walls forming the outsides of the box-like structure during transport have a corresponding load carrying capability and strength.

Figure 4A:
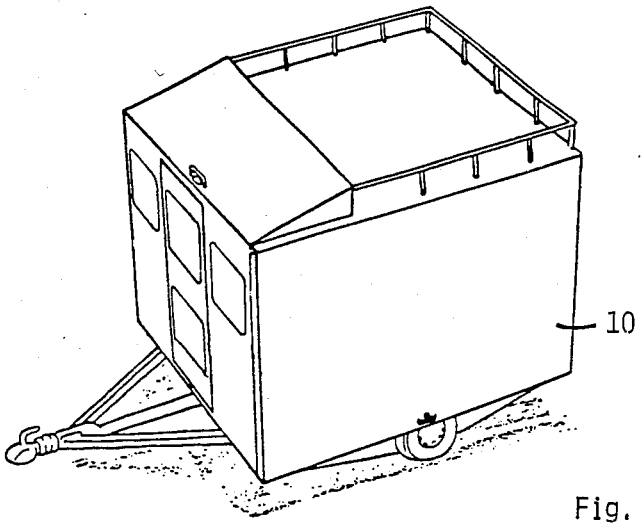
FIGS. 4*a* and 4*b*, another advantageous exemplary embodiment in the form of a small house trailer.
Figure 4B:
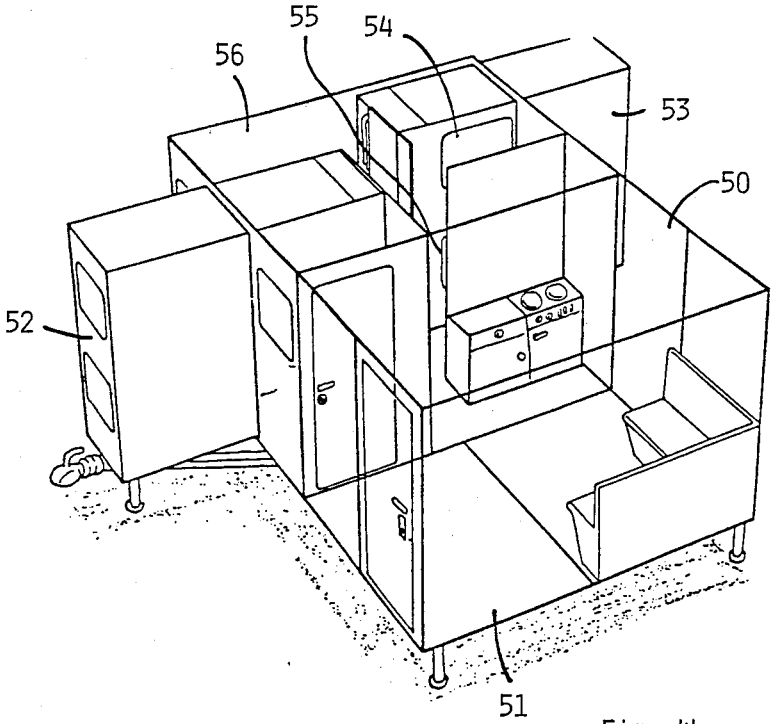

Another advantageous embodiment is shown in FIGS. 4*a* and *b* in perspective view, constructed as a mobile house trailer. FIG. 4*a* shows the trailer in a ready-to-roll configuration, while FIG. 4*b* shows it in the state of expansion for comfortable occupancy.

The trailer 50 has firstly an expansion area 51, which is formed corresponding to the expansion area of the previously shown exemplary embodiment—referring to a side wall. In the direction toward the vehicle there are disposed two additional cabin elements 52 and 53, which each consist of a cot area with two beds atop of one another. These elements can be pulled out in the form of drawers, wherein hatches 54 or 55 are provided in connection with each cot, which are, in the transport configuration, disposed mirror-reversed next to each other. Each cabin element therefore is pushed into the walk space of the other for transporting. The walk space, serving as a changing room, thus is created when the cabin elements are pulled apart, which are accessible either from the outside or from the remainder of the inner space 51. If the cabin elements are pulled out more than half, an inner corridor is created, while with lesser pulling-out separate cabin areas are created, which can be made accessible by separate doors from the outside.

Telescoping rails or rollers may be used for the pushing-together, which are also not shown. The expandable part 56, which contains the cot, is formed as "drawer-like pull-out" with a roof, it therefore has a high degree of innate stability because of its box-like structure.

During the pushing-together the cot area of the one cabin element is pushed back into the changing room of the opposite cabin element. At the same time the support means are hinged inwardly. This decreases the length of the vehicle structure to the size of that of customary small house trailers.

The last mentioned embodiment creates, in an advantageous manner, a transportable shelter with a comparatively large living space and separate, but roomy, sleeping cabins with their own changing areas.

The shelter according to the invention is not only suitable for tourist use, but also for construction sites. It can be used in all circumstances where several people or groups, such as, for instance, families, sportsmen or other people with mutual activities must be sheltered comfortably and quickly for a limited or prolonged period of time in comfort.

The shelter according to the invention can be folded out or folded shut quickly and without problems and can be easily and cheaply transported. It does not require a prepared lot, only connections for water and electricity. The furniture can preferably be expanded or can be in the form of a kit.

The invention is not limited in its design to the preferred exemplary embodiment shown above. A number of variants can be contemplated, making use of the example shown even with basically different designs.

I claim:

1. A shelter with dimensions reducible for transport, having a box-like structure including four side walls in the transport configuration, characterized in that in order to enlarge the inner space and based on the box-like structure, each of said side walls is outwardly movable mainly parallel to its position in the transport configuration, wherein are provided for creating the connecting between the box-like basic structure and each movable side wall:

additional side walls, connected to each movable side wall as well as to the box-like basic structure, disposed accordion-like in foldable fashion, and a floor and a ceiling plate each for the room area enlarged over the box-like basic structure, which are hingeably fastened on the upper or lower edge of the box-like basic structure, and in that the lateral distance of the movable side wall from the box-like basic structure in its outwardly displaced state is generally equal to the height of the basic structure.

2. A shelter according to claim 1, characterized in that the surfaces which are outside in the transport configuration are constructed in the same way as the surfaces of a transport container and are equipped with corresponding hardware necessary for transport and, in this configuration, have the dimensions of such a transport container.

3. A shelter according to claim 2, characterized in that devices for the common stacking with like transport containers or the like containers in the transport configuration are provided.

4. A shelter according to claim 1, characterized in that a generally diagonally extending separating wall is provided in two room units within the box-like basic structure.

5. A shelter according to claim 4, characterized in that that each room unit within the container structure has separately built in supply devices and, if necessary, furniture.

6. A shelter according to claim 4, characterized in that the separating walls have at least one connecting door.

7. A shelter in accordance with claim 1, characterized in that the unfoldable elements can be connected by means of grooves on their outer edges in the folded-open state.

8. A shelter in accordance with claim 1, characterized in that an outer door and/or window are provided in a foldable outer wall.

9. A shelter in accordance with claim 1, characterized in that the diagonal splitting of the base surface by means of the separating wall is generally mirror reversed.

10. A shelter in accordance with claim 1, characterized in that in the area of a part of the separating wall the common apparatus or supply devices for both room units are disposed.

11. A shelter in accordance with claim 1, characterized in that furniture elements are fastened to at least one of the hingeable floor plates fastened to the lower longitudinal edge of the basic structure, which in the folded-in state of the floor plate are inside the box-like basic structure and fit in with the fixedly disposed furniture elements there.

12. A shelter in accordance with claim 1, characterized in that the box-like basic structure is also stackable in the extended state.

13. A shelter in accordance with claim 11, characterized in that two shelters stacked atop each other are connectable by means of telescoping stairs, provided in the floor of the inner part of the upper shelter in the manner of a stairs hidden by a trap door.

14. A transportable shelter comprising:

a rectangular frame structure and an extendable body structure, wherein said body structure includes at least one pivotal floor plate, at least one pivotal ceiling plate and four movable side walls, each of said side walls having a transport position in which said side wall is adjacent said frame structure and a deployed position in which said side wall is spaced transversely from said transport position; said body structure further including connecting walls, wherein each of said connecting walls is attached to a portion of a respective side wall and said frame structure, and each said connecting wall movable with its respective side wall as said side wall is moved from said transport position.

* * * * *